US006186329B1

(12) United States Patent
Qiu

(10) Patent No.: US 6,186,329 B1
(45) Date of Patent: Feb. 13, 2001

(54) MULTIPLE-GRADE PAPER CORNER POST

(75) Inventor: Yanping Qiu, Middleton, WI (US)

(73) Assignee: Sonoco Development, Inc., Hartsville, SC (US)

( * ) Notice: Under 35 U.S.C. 154(b), the term of this patent shall be extended for 0 days.

(21) Appl. No.: 09/384,583

(22) Filed: Aug. 27, 1999

(51) Int. Cl.[7] ..... B65D 81/05
(52) U.S. Cl. ..... 206/586; 206/320; 428/34.2
(58) Field of Search ..... 206/586, 591, 206/592, 320, 326; 248/345.1; 428/34.2

(56) References Cited

U.S. PATENT DOCUMENTS

| | | | |
|---|---|---|---|
| 3,536,245 | 10/1970 | Palmer . | |
| 4,399,915 | 8/1983 | Sorenson . | |
| 4,482,054 | 11/1984 | Gardner . | |
| 4,483,444 | 11/1984 | Gardner . | |
| 4,496,054 | 1/1985 | Koltun . | |
| 4,771,893 | 9/1988 | Liebel . | |
| 4,811,840 | 3/1989 | Muyskens . | |
| 5,131,541 | 7/1992 | Liebel . | |
| 5,181,611 | 1/1993 | Liebel . | |
| 5,267,651 | 12/1993 | Hughes . | |
| 5,275,677 * | 1/1994 | Morley | 206/586 |
| 5,538,778 | 7/1996 | Hurwitz . | |
| 5,593,039 | 1/1997 | Ortlieb . | |
| 5,680,934 | 10/1997 | Jaegers . | |
| 5,688,578 | 11/1997 | Goodrich . | |
| 5,799,797 | 9/1999 | Braun . | |
| 5,813,537 | 9/1998 | DeReu . | |

* cited by examiner

*Primary Examiner*—Jim Foster
(74) *Attorney, Agent, or Firm*—Bullwinkel Partners, Ltd.

(57) ABSTRACT

An improved post made of multiple sheets of paper for supporting and cushioning a product. The sheets are joined end to end and wound into a tubular shape having a strong-weak-strong profile in the transverse direction. The ends of the sheets are joined together in such a way that the post has a uniform wall thickness.

21 Claims, 5 Drawing Sheets

MULTIPLE-GRADE PAPER CORNER POST

BACKGROUND

1. Field of the Invention

This patent relates to packaging for large appliances such as washers, dryers and refrigerators. More particularly, this patent relates to an improved tubular-type corner post or side post comprising more than one grade of paper in the transverse direction.

2. Description of the Related Art

Corner posts are used to cushion the corners of large, heavy appliances (such as washers, dryers, refrigerators, dishwashers and stoves) during storage and transport and to provide resistance against axially directed compressive loads.

Conventional tubular corner posts are made of a single sheet of paper wound into a convolute (coiled) tube. Adhesive is often used to bond the paper layers. Before the adhesive dries, the tube is shaped into the desired shape, typically one with a modified "L" shaped cross section to fit snugly between the corner of an appliance and the corner of the appliance container.

One disadvantage of conventional corner posts is that they are made from only a single grade of paper. Because only a single grade of paper is used, the interior, middle and exterior layers of the corner post wall are made of the same grade of paper. Savings can be realized by substituting less expensive paper in the middle of the corner post wall.

Thus the primary object of the present invention is to provide an improved corner post that can be made from more than one type of paper.

Another object of the present invention is to provide a corner post having different grades of paper along the transverse direction.

Yet another object of the present invention is to provide a corner post having a strong-weak-strong paper configuration along the transverse direction.

Another object of the present invention is to provide a corner post having better cushion in the transverse direction.

Still another object of the present invention is to provide a corner post that is less expensive to manufacture than conventional corner posts.

Further and additional objects will appear from the description, accompanying drawings, and appended claims.

SUMMARY OF THE INVENTION

The present invention is an improved post for supporting and cushioning a product. The post has an outer wall and an inner wall substantially coextensive with the outer wall. The outer and inner walls are laterally spaced from one another and define a hollow interior therebetween.

The post is made from a blank comprising at least two, and preferably three, sheets of paper. When the blank is wound and formed into a tube, the second sheet is interposed between the first and third sheets in the transverse direction.

The ends of the sheets are joined together in such a way that the post has a uniform wall thickness. In one embodiment the adjoining ends of the sheets are skived and joined together with adhesive. In another embodiment the adjoining ends are densified and the overlapping areas are joined with adhesive.

THE DRAWINGS

DETAILED DESCRIPTION OF THE INVENTION

Figure 1:
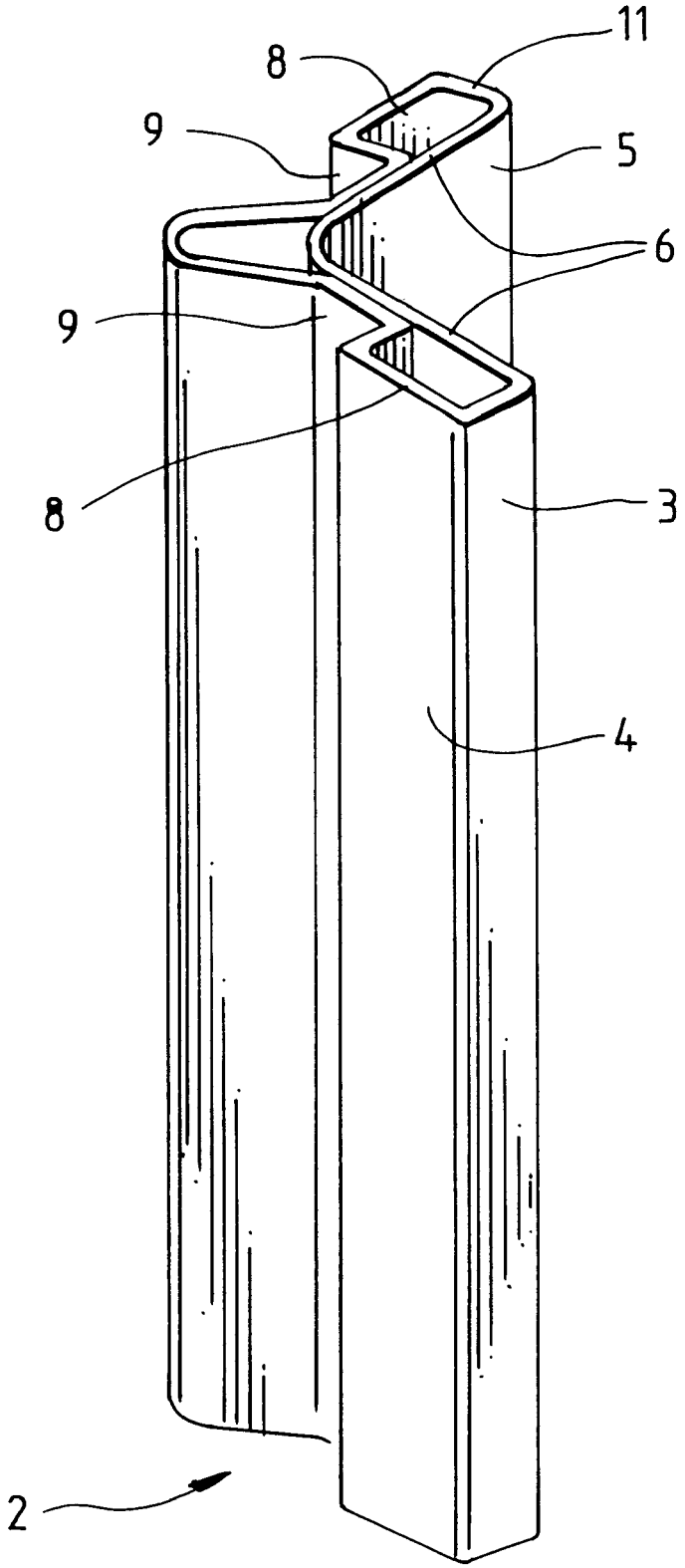
FIG. 1 PRIOR ART
FIG. 1 is a perspective view of a prior art corner post.

Turning to the drawings, there is shown in FIG. 1 a perspective view of a conventional tubular-type corner post 2. The corner post 2 normally extends from a base pad (not shown) located at the bottom of a product package to a top cap or lid (not shown). The corner post 2 protects and cushions the product from horizontal forces, both lateral and transverse, such as during handling. In addition, the corner post helps support the package against vertical (longitudinal) forces, such as when packages are stacked.

Figure 2:
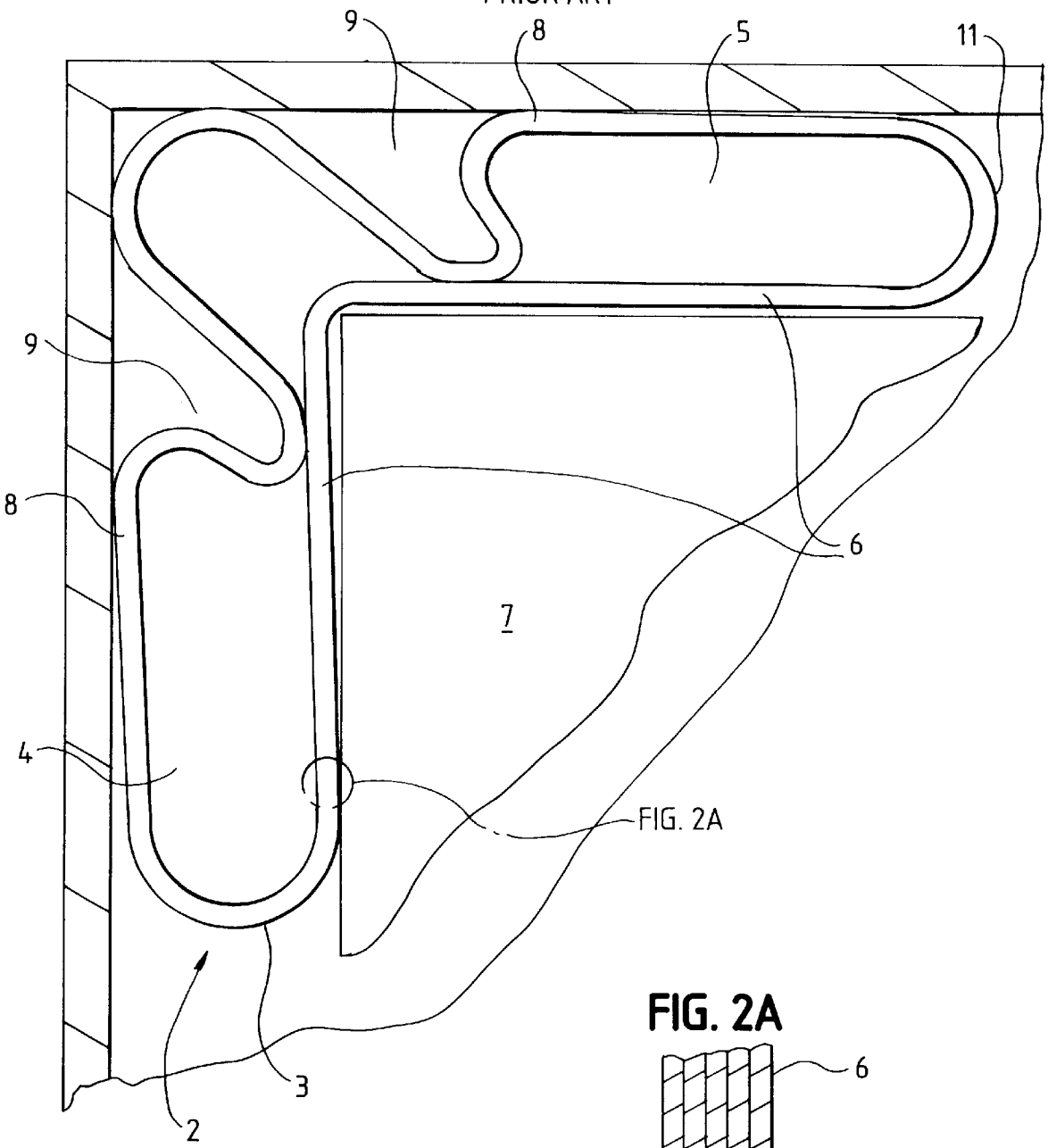
FIG. 2 PRIOR ART
FIG. 2 is a cross-sectional view of the prior art corner post of FIG. 1 partially enlarged to show the uniform paper layer configuration.
Figure 2A:
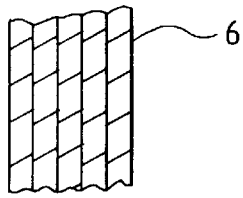

As best seen in the cross-sectional view of FIG. 2, the corner post comprises two legs 4, 5 substantially perpendicular to each other and terminating in rounded ends 3, 11. The legs 4, 5 are formed by an inner wall 6 (being defined as the wall closest to the product 7) and an outer wall 8 in generally parallel spaced relation to each other to form a hollow core.

Inwardly extending beads or grooves 9 are formed in the outer wall 8 along each leg, at a point spaced from the rounded ends 3, 11. As best shown in FIG. 1, the beads 9 extend the entire vertical length of the outer wall 8. The beads 9 may contact the inner wall 6, thus forming multiple enclosed areas within the corner post 2.

Corner posts may be used in the following manner. After manufacture, the product (typically a large appliance) is placed on and fastened to a pallet or base having dimensions greater than the width and depth of the appliance to accommodate corner posts. A protective sleeve typically made of paperboard or corrugated board is placed over the appliance to form the four sidewalls of the container. The sleeve fits inside the perimeter of the base. The corner posts are placed around the appliance between the appliance and the protective sleeve. A paperboard or corrugated top is placed over the package. Straps may be wrapped around the container to better secure the corner posts between the appliance and the container. The packaged appliances may be stacked on top of each other.

The corner post typically is formed of paper or paperboard convolutely wound into a tubular configuration and formed into a desired shape. As shown in the enlarged portion of FIG. 2, conventional corner posts are made of a single grade of paper. The single sheet is wound into a paper tube having multiple layers. For example, the corner post illustrated in FIG. 2 has five layers of wound paper.

Adhesive may be applied between the paper layers. Before the adhesive dries, the convolute tube is shaped into the desired cross-sectional shape. The corner post should be shaped to fit snugly between the corner of an appliance and the corners of the appliance container.

Because only a single grade of paper is used, the interior, middle and exterior layers of the corner post wall are made of the same grade of paper. In some instances, however, it may be desirable to form a corner post from multiple grades of paper, for example, one having less expensive (weaker) paper in the middle layer(s) and more expensive (stronger) paper in the outer layer(s).

Figure 3:
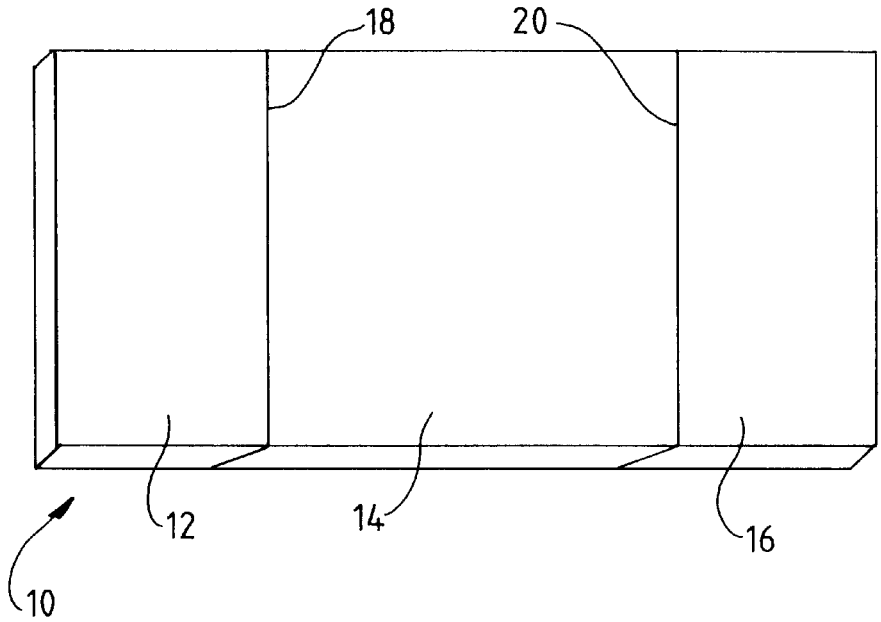
FIG. 3 is a perspective view of a paper blank used to form the corner post of the present invention, not drawn to scale.
Figure 4:
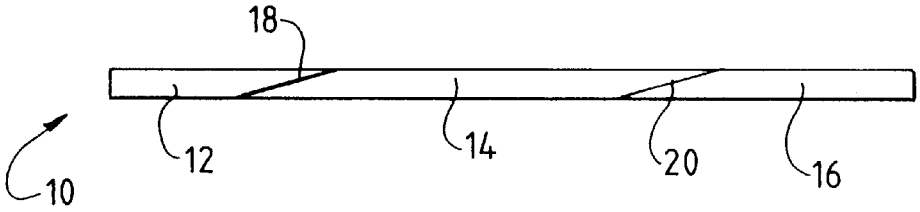
FIG. 4 is a side view of the paper blank of FIG. 3.

I have developed a unique corner post formed of multiple sheets of paper joined end to end. The corner post is manufactured from a blank 10, one embodiment of which is shown in FIGS. 3 and 4. In this particular embodiment, the blank 10 is formed by joining end-to-end three sheets of paper: a first sheet 12, a second sheet 14 and a third sheet 16. The first sheet 12 is joined to the second sheet 14 along one end 18 of the second sheet 14. The third sheet 16 is joined to the second sheet 14 along an opposite end 20 of the second sheet 14.

Preferably, the first and third sheets 12, 16 are made from material that is stronger than the material that makes up the second sheet 14. For example, the first and third sheets 12, 16 may be made from a relatively stronger grade of paper while the second sheet 14 is made from a relatively weaker grade of paper.

Although the example illustrated in FIGS. 3 and 4 comprises a three-sheet design featuring two grades of paper, it will be appreciated that the number of sheets and types of material used may be varied from the illustrated example. For instance, the three sheets may each comprise a different material. However, as will be discussed more fully below, where three different grades of material are used, it is preferable that the first and third sheets be made of material stronger than that used for the second sheet. In still other instances, the corner post may be made from two, four or even five or more sheets, allowing for many different combinations of materials.

The sheets may be joined to one another end to end by adhesive. Alternatively, the sheets may be joined by taping them together with paper-backed tape or by other suitable means.

A key aspect of the invention is that the ends of the sheets are joined together in such a way that the corner post has a uniform wall thickness. In the embodiment shown in FIGS. 3 and 4, for example, the ends of the sheets are skived. As best shown in FIG. 4, the skived ends provide additional surface area where the sheets are joined for better adherence between the sheets. Preferably, the sheets are skived at the same angle so that the jointed sheets have a uniform thickness.

Figure 5:
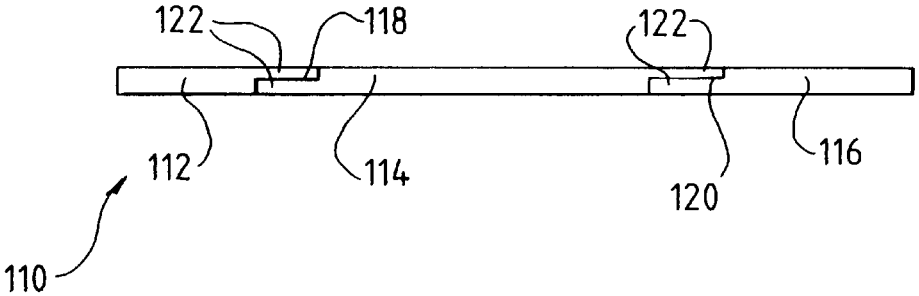
FIG. 5 is a side view of a second embodiment of a paper blank.

In a second embodiment 110 shown in FIG. 5, the ends of the sheets 112, 114, 116 are compressed or densified and the overlapping densified sections 122 are glued together at either end 118, 120 of the second sheet 114.

In either case, the skived or densified areas must be wide enough for the joined surfaces to survive the manufacturing process without separating.

Figure 6:
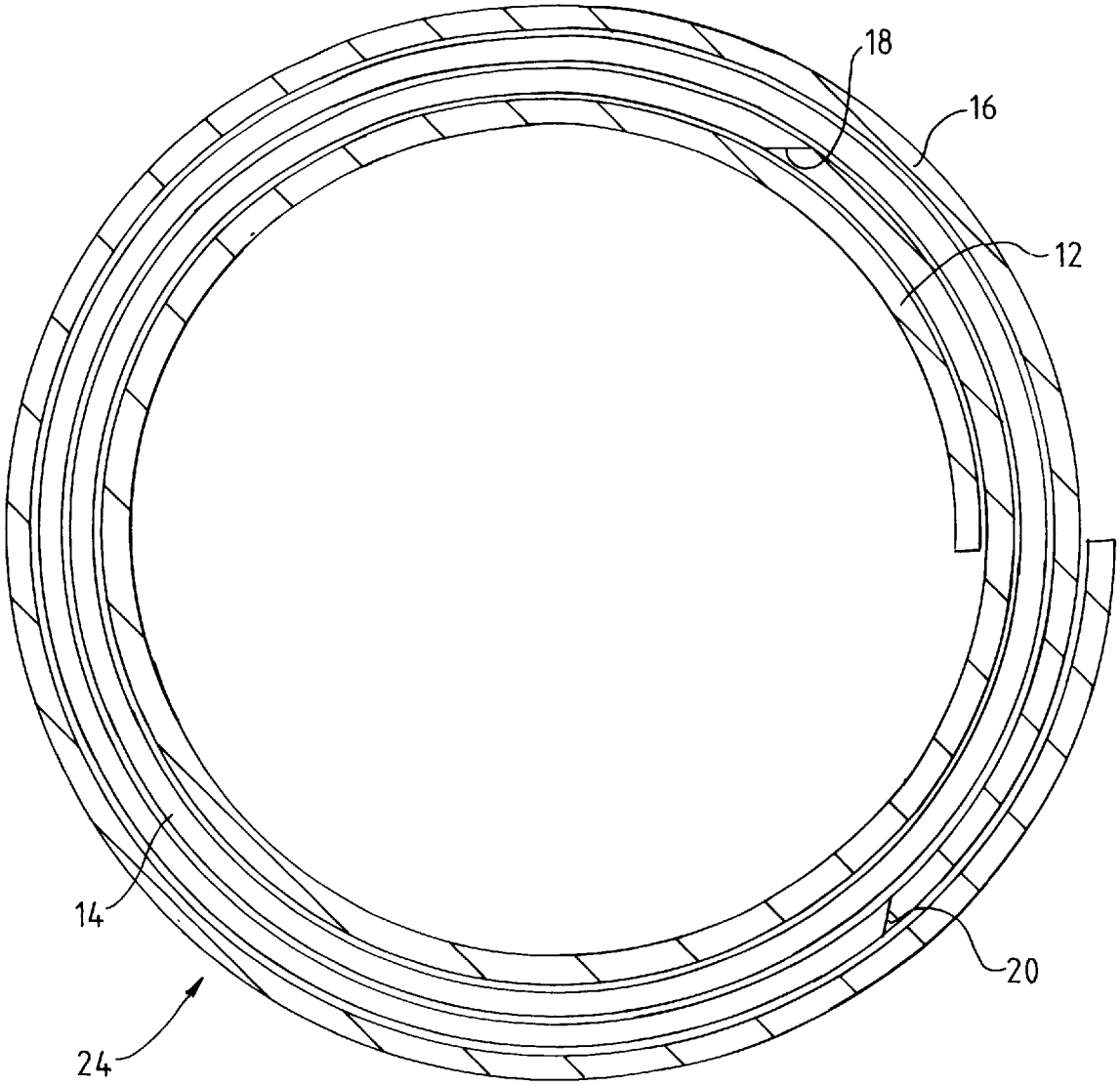
FIG. 6 is a top plan view of the paper blank of FIG. 3 shown loosely wound.

When the blank 10 of FIGS. 3 and 4 is convolutely wound into a tube, the second (middle) sheet 14 becomes interposed between the first and third sheets 12, 16 in the transverse direction. FIG. 6 shows the relative configuration of the three sheets 12, 14, 16 when loosely wound. The interior of the loosely wound tube 24 is formed by the first sheet 12, the exterior is formed by the third sheet 16, and the second sheet 14 is interposed therebetween.

After the blank 10 is wound into a tube (and before the adhesive applied between the paper layers is set), the tube 24 is formed on a mandrel into a corner post having a desired cross-sectional shape. An example of one such corner post 26 is provided in FIG. 7. Like the conventional corner post 4 of FIG. 2, the corner post 26 of FIG. 7 comprises two legs 28, 30 substantially perpendicular to each other which terminate in rounded ends 29, 31. The legs 28, 30 are formed by an inner wall 34 and an outer wall 36 with hollow spaces therebetween. Inwardly extending beads are formed in the outer wall 36 along each leg 28, 30 and extend the entire vertical length of the outer wall 36. The beads 38, 39 contact the inner wall 34, thus forming multiple enclosed areas within the corner post 26.

Figure 7:
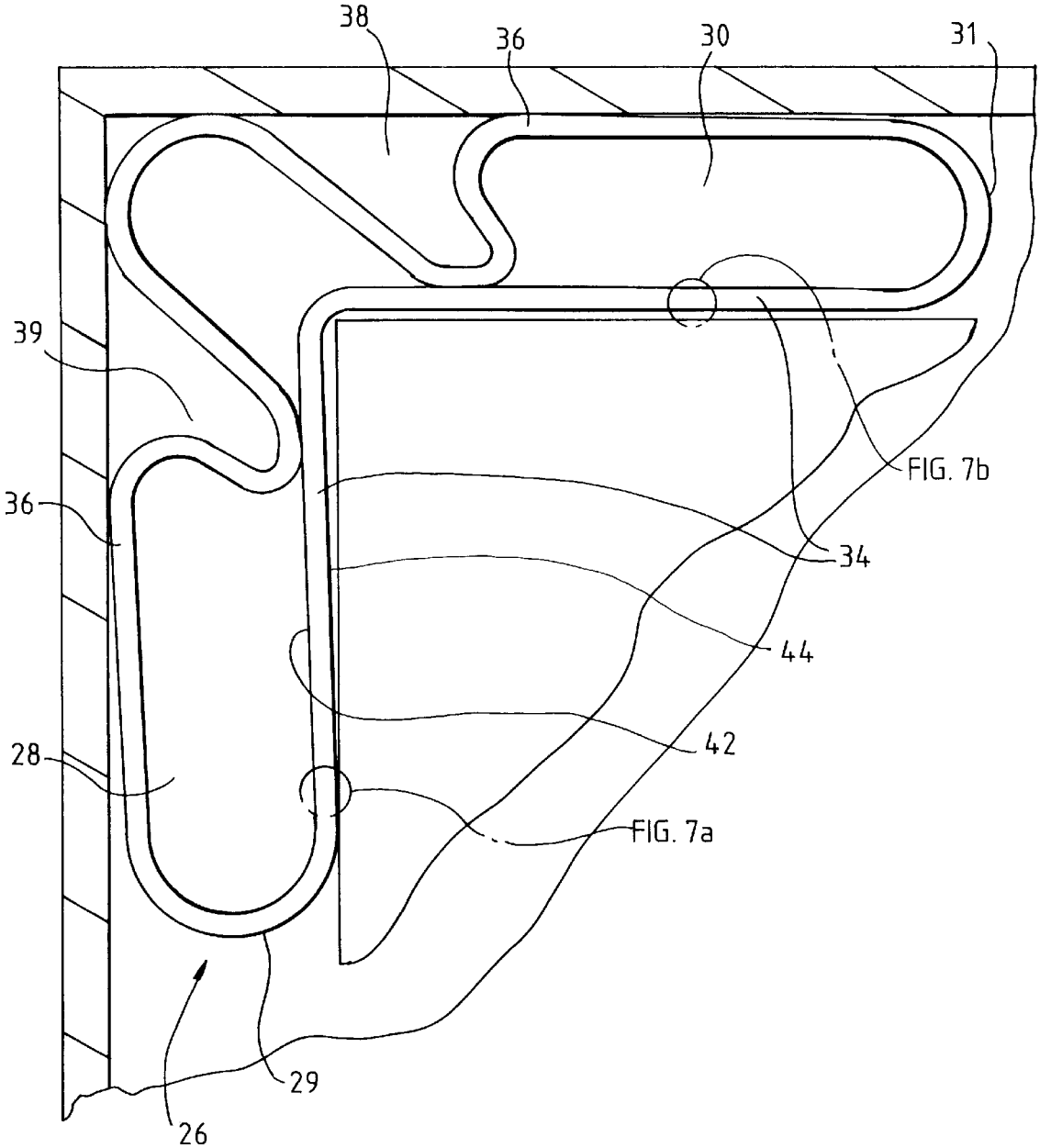
FIG. 7 is a cross-sectional view of a corner post made according to the present invention.
Figure 7A:
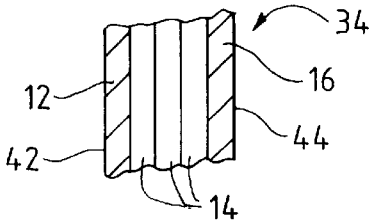
FIGS. 7*a* and 7*b* are partially enlarged views of the corner post of FIG. 7 showing the unique non-uniform paper configuration.

Unlike the corner post of FIG. 2 which is formed from a single sheet of material, the corner post of FIG. 7 is formed from three sheets of material. As best shown in enlargements 7*a* and 7*b*, the first sheet 12 forms the interior surface 42 of the corner post 26, i.e., the surface facing the hollow interior. The third sheet 16 forms the exterior surface 44 of the corner post. The second sheet 14 is interposed between the first and third sheets and thus is not exposed except along the top and bottom edges of the corner post 26.

Figure 7B:
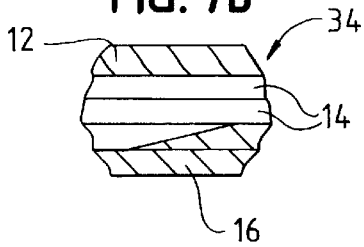

In the embodiment illustrated in FIG. 7*b*, the ends of the sheets are skived. However, as discussed above, other end configurations are anticipated, including densifying the ends as shown in FIG. 5.

Preferably, the first and third sheets (i.e. the interior and exterior layers) are made from a stronger grade of paper while the second sheet is made from a weaker grade of paper, perhaps corrugated. In other words, the resulting corner post has a strong-weak-strong configuration in the transverse (thickness) direction.

To manufacture the corner post of FIG. 7, two rolls of stronger paper and one roll of weaker paper are lined up. The paper is skived at the ends, then glued together through two small glue pots. The paper is then cut into sheets having the desired vertical length, i.e., the length of the finished corner post. The remainder of the process is the same as that for making a conventional tubular type corner post.

Using less expensive weaker paper in the middle of the corner post results in an economic savings. In addition, allowing for the use of more than one type of material provides for more flexibility and cushioning effect in terms of the lateral structural properties of the corner post.

Thus the present invention provides an improved corner post that can be made from more than one type of paper. The present invention allows for the use of multiple grades of paper or other sheetlike materials, which can result in cost savings and increased flexibility and cushioning regarding the lateral structural properties of the finished corner post.

While the embodiment described above is a multiple-grade paper corner post, it is to be understood that other tubular type supports may be made according to the invention. For example, it is anticipated that a substantially I-shaped side post may be made according to the invention. The side post, like the corner post, is made from a multiple-sheet blank wound into a tube and formed on a mandrel into a post having a desired cross-sectional shape. The side post would be used to support and cushion the sides of products.

Further modifications and alternative embodiments of the invention are contemplated which do not depart from the spirit and scope of the invention as defined by the foregoing teachings and appended claims. It is intended that the claims cover all such modifications that fall within their scope.

I claim as my invention:

1. An improved post for supporting and cushioning a product, said post having an outer wall and an inner wall substantially coextensive with said outer wall, said outer and inner walls being laterally spaced from one another and defining a hollow interior therebetween, the improvement comprising:

a first sheet made from one grade of paper and having opposite ends, one end being joined to an end of a second sheet made from a different grade of paper, a third sheet joined to the end of the second sheet opposite the first sheet, said sheets forming a blank that is convolutely wound and formed into a post.

2. The post of claim 1 wherein after winding the second sheet is interposed between the first and third sheets along the transverse direction of the post.

3. The post of claim 2 wherein the first and third sheets are made from relatively stronger paper and the second sheet is made from relatively weaker paper.

4. The post of claim 3 in which the adjoining ends of the sheets are skived.

5. The post of claim 3 in which the adjoining ends of the sheets are densified and overlap along the densified areas.

6. The post of claim 4 in which the skived ends are joined with adhesive.

7. The post of claim 4 in which the skived ends are joined with tape.

8. The post of claim 5 in which the densified ends are joined with adhesive.

9. The post of claim 4 in which the densified ends are joined with tape.

10. An improved corner post for supporting and cushioning a product, said corner post made from a blank convolutely wound and formed into a substantially L-shaped post having an outer wall and an inner wall substantially coextensive with said outer wall, said outer and inner walls being laterally spaced from one another and defining a hollow interior therebetween, the improvement comprising forming said blank from:

a first sheet of paper;

a second sheet of paper made from a weaker grade of paper than the first sheet and joined to an end of the first sheet; and a third sheet of paper made from a stronger grade of paper than the second sheet and joined to an end of the second sheet opposite the first sheet;

wherein upon winding and forming of the post the second sheet is interposed between the first and third sheets along the transverse direction of the corner post.

11. The corner post of claim 10 wherein the adjoining ends of the sheets are skived and joined together with adhesive.

12. The corner post of claim 10 wherein the adjoining ends of the sheets are densified and the densified areas overlap and are joined together with adhesive.

13. An improved side post for supporting and cushioning a product, said side post made from a blank convolutely wound and formed into a substantially I-shaped post having an outer wall and an inner wall substantially coextensive with said outer wall, said outer and inner walls being laterally spaced from one another and defining a hollow interior therebetween, the improvement comprising forming said blank from:

a first sheet of paper;

a second sheet of paper made from a weaker grade of paper than the first sheet and joined to an end of the first sheet; and a third sheet of paper made from a stronger grade of paper than the second sheet and joined to an end of the second sheet opposite the first sheet;

wherein upon winding and forming of the post the second sheet is interposed between the first and third sheets along the transverse direction of the side post.

14. The side post of claim 13 wherein the adjoining ends of the sheets are skived and joined together with adhesive.

15. The corner post of claim 13 wherein the adjoining ends of the sheets are densified and the densified areas overlap and are joined together with adhesive.

16. An improved post for supporting and cushioning a product, said post having an outer wall and an inner wall substantially coextensive with said outer wall, said outer and inner walls being laterally spaced from one another and defining a hollow interior therebetween, the improvement comprising:

a first sheet made from one grade of paper and having opposite ends, one end being joined to an end of a second sheet made from a different grade of paper to form a blank, said blank then being convolutely wound and formed into a post, wherein the adjoining ends of the sheets are skived.

17. The post of claim 16 in which the skived ends are joined with adhesive.

18. The post of claim 16 in which the skived ends are joined with tape.

19. An improved post for supporting and cushioning a product, said post having an outer wall and an inner wall substantially coextensive with said outer wall, said outer and inner walls being laterally spaced from one another and defining a hollow interior therebetween, the improvement comprising:

a first sheet made from one grade of paper and having opposite ends, one end being joined to an end of a second sheet made from a different grade of paper to form a blank, said blank then being convolutely wound and formed into a post, wherein the adjoining ends of the sheets are densified and overlap along the densified areas.

20. The post of claim 19 in which the densified ends are joined with adhesive.

21. The post of claim 19 in which the densified ends are joined with tape.

* * * * *